US007330558B2

(12) United States Patent
Arz et al.

(10) Patent No.: US 7,330,558 B2
(45) Date of Patent: Feb. 12, 2008

(54) REMOTE CONTROL FOR HEARING AID DEVICES

(75) Inventors: Winfried Arz, Nürnberg (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 661 days.

(21) Appl. No.: 10/953,305

(22) Filed: Sep. 29, 2004

(65) Prior Publication Data

US 2005/0105751 A1 May 19, 2005

(30) Foreign Application Priority Data

Sep. 29, 2003 (DE) ..... 103 45 174

(51) Int. Cl.
*H04R 25/00* (2006.01)

(52) U.S. Cl. ..... 381/315; 381/322

(58) Field of Classification Search ..... 381/60, 381/312, 315, 320, 321, 322
See application file for complete search history.

(56) References Cited

U.S. PATENT DOCUMENTS 4,918,737 A 4/1990 Luethi
4,947,432 A 8/1990 Topholm

FOREIGN PATENT DOCUMENTS

DE 100 48 342 3/2002

*Primary Examiner*—Suhan Ni
(74) *Attorney, Agent, or Firm*—Schiff Hardin LLP

(57) ABSTRACT

A remote control for a hearing aid device prevents incorrect operation by having operating elements that effect a signal transmission from the remote control to a hearing aid device disposed on a first side of the remote control housing, and operating elements that additionally effect a signal transmission from the hearing aid device back to the remote control disposed on a second housing side of the remote control. The first and second housing sides are disposed in an easily tactilely distinguishable relation to each other, such as by being substantially orthogonal. The different functions of the operating elements and therefore can be differentiated purely by contact with the remote control.

9 Claims, 1 Drawing Sheet

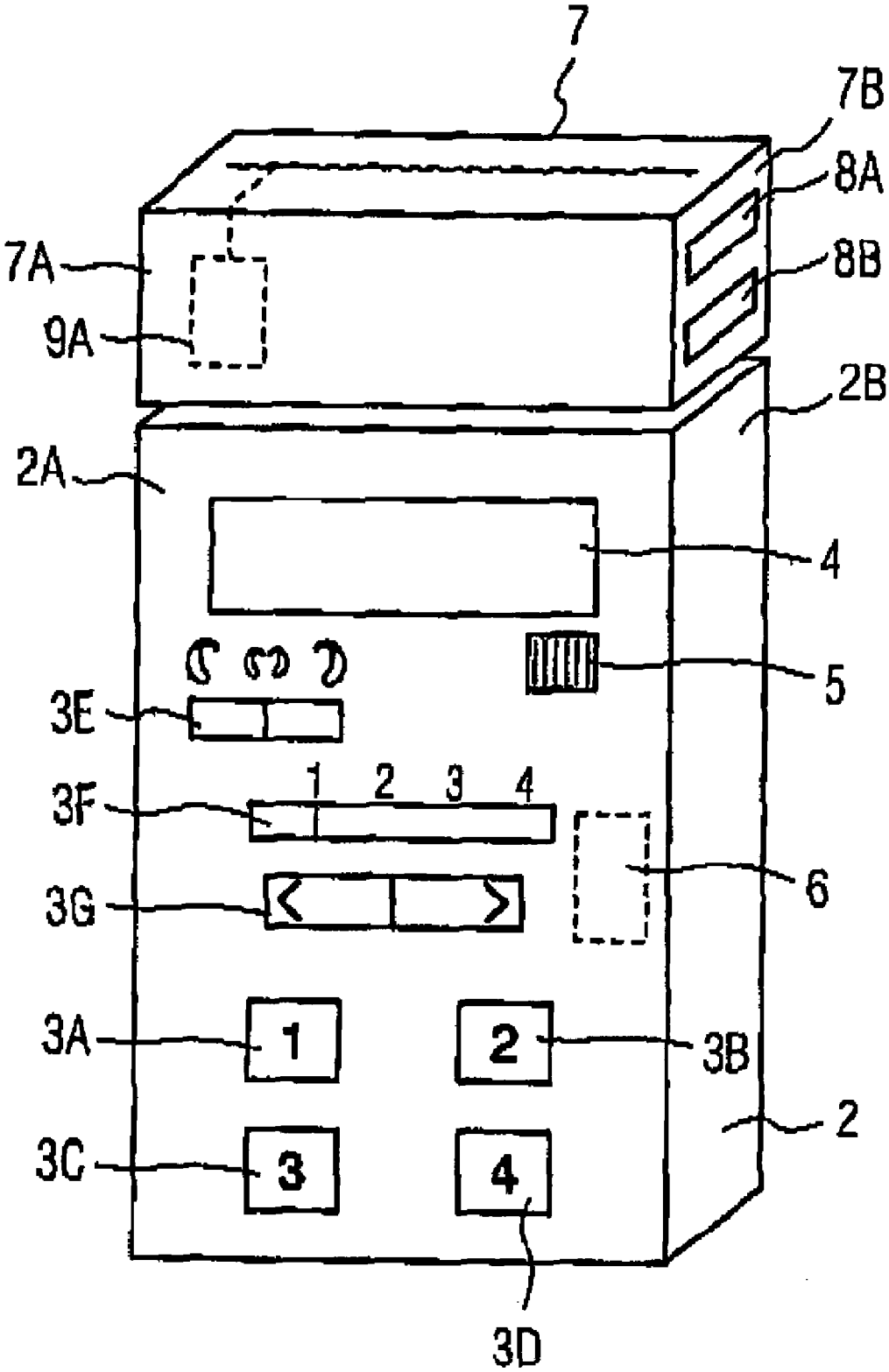
7
7B
8A
8B
7A
9A
2B
2A
4
5
3E
1 2 3 4
3F
6
3G
3A
1
2
3B
2
3C
3
4
3D

REMOTE CONTROL FOR HEARING AID DEVICES

BACKGROUND OF THE INVENTION

1. Field of the Invention

The present invention concerns remote control for hearing aid devices.

2. Description of the Prior Art

For many hearing aid device users, an optimally unobtrusive manner of wearing or carrying the hearing aid device is preferred. Advances in miniaturization of these devices in particular contribute to this. In addition to in-the-ear hearing aids that are nearly no longer externally visible, behind-the-ear hearing aids can be worn in a very unobtrusive manner. Problems in the operation of the devices, however, arise due to the advancing miniaturization. At best a few operating elements can still be arranged on the housing of a significantly miniaturized hearing aid device. Nevertheless, in order to enable an operation of the hearing aid devices, remote controls are therefore increasingly used. With these remote controls, the desire also exists to be able to optimally unobtrusively handle and operate them.

A remote control for a hearing aid device fashioned as a wristwatch is known from European Application 0 298 323. This has an electrically-conductive watch base and a conductor path on the watch glass is forming a plate capacitor. Wireless control commands can be transmitted to the hearing aid device via this remote control, for example for volume adjustment or to adjust a tone filter.

From German Patent 100 48 342, a remote control for a hearing aid device is known that includes means for storage of the hearing aid device and/or of hearing device accessories on the remote control. Thus, for example, a fastening loop or a replacement energy module for the hearing aid device can be carried on the remote control.

German OS 36 42 828 discloses a programmable hearing device having an external control device serving as a remote control fashioned as a wristwatch. This control device has a housing with a keypad and a digital display. The keypad Is used with various functions. Operating buttons for a program selected are located at the edge of the housing, thus on a surface that is orthogonal to the surface with the keypad. Transmission of a signal from the hearing device to the remote control is not provided.

SUMMARY OF THE INVENTION

An object of the present invention is to ease the operation of a hearing aid device by means of a remote control.

This object is achieved by a remote control for a hearing aid device that has a housing with a number of housing sides disposed substantially orthogonally to one another, with operating elements on a first housing side, the actuation of which by a user effects the transmission of a control signal from the remote control to the hearing aid device, and at least one second operating element on a second housing side that is substantially orthogonal to the first housing side, the operation of which by a user effects both the transmission of a signal from the remote control to the hearing aid device and the transmission of a signal from the hearing aid device to the remote control The remote control generates a humanly perceptible indication of a hearing aid device property, a hearing aid device state or a hearing aid device setting from the signal transmitted to the remote control. The indicator may be a visual display, an audible signal, or a tactile (haptic) signal.

Since, with the remote control according to the invention, operating elements are arranged on different housing sides, in particular housing sides substantially orthogonal to one another, different functions that can be executed with the remote control can be differentiated in a simple manner even without direct observation of the remote control. Particularly with the remote control according to the invention, a strict differentiation ensues between functions that require a pure signal transmission from the remote control to one or more hearing aid devices, and functions based on which a further signal is transmitted back from the hearing aid device to the remote control as a reaction to a signal transmitted from the remote control to the hearing aid device. Functions that require only a transmission of a signal from the remote control to the hearing aid device are, for example, program switching or volume adjustment. Functions that require a return transmission of a signal from the hearing aid device to the remote control are, for example, display of the currently set acoustic program, which is in particular of interest when the pertaining hearing aid device implements an associated automatic environment analysis and an automatic program selection. A further example is the display of the current charge state of the hearing aid device battery.

By the separation of the operating elements onto different orthogonal housing sides, a strict distinction is possible between functions that require only a uni-directional signal transmission and functions that require a bi-directional signal transmission. A user therefore can easily memorize the separation of the different functions for the various operating elements. Furthermore, the remote control according to the invention preferably exhibits a relatively large top side and, in comparison thereto, a relatively small side surface. The different sides of the housing of the remote control, and therewith the different functions of the elements disposed on the respective housing sides, thus can easily be differentiated purely by touch of the remote control. A function intended by a user thus can be reliably executed with the remote control according to the invention, even, for example, in dark surroundings or with the remote control located in a pocket. Confusions in the operation are thus largely prevented.

In a preferred embodiment of the invention functions that exclusively require a signal transmission from the remote control to at least one hearing aid device are exclusively initiated by operating elements arranged on the housing top side of the remote control. Operating elements with the functions associated therewith that require a return transmission of a signal from the hearing aid device to the remote control are exclusively arranged on a side of the housing of the remote control, orthogonal to the top side.

In an embodiment of the invention, the remote control is designed modularly. The remote control has, for example, a base module that enables only a transmission function from the remote control to the hearing aid device. If the user desires an expanded functionality of this remote control, this can be expanded by a detachable receiving unit that can be connected with the base module. Operating elements that can be available for functions involving a signal transmission from a hearing aid device to the receiving module can be arranged on the base module, and be nonfunctional if the remote control not expanded by a receiving module. Only when the base module is connected with a receiving module is a function assigned to these operating elements. Such operating elements for functions involving signal transmission from a hearing aid device to the remote control, however, preferably are located on the receiving module, with these operating elements being disposed on a side surface of the receiving module that is substantially orthogonal to the housing side of the base module on which the operating elements of the base module are disposed.

DESCRIPTION OF THE DRAWINGS

The single FIGURE shows an exemplary embodiment of a remote control according to the invention with a base module and a receiving module.

DESCRIPTION OF THE PREFERRED EMBODIMENTS

The top side 2A and the right side 2B of the housing are visible from the perspective view of the remote control 1 according to the FIGURE. A number of operating elements are located on the housing top side 2A. These are the program selection keys 3A-3D, by means of which different auditory programs can be set in a hearing aid device operated by means of the remote control 1. Furthermore, a sliding switch is present via which a selection can be made as to whether the operation of an operating element on the remote control 1 should only have effect on a hearing aid device at the left ear or on a hearing aid device at the right ear (left or right positions of the sliding switch 3E, respectively), or whether (given binaural hearing assistance to a hearing aid device user) both hearing aid devices should be simultaneously controlled by the remote control (middle setting of the sliding switch 3E).

The remote control 1 according to the invention furthermore has a second sliding switch 3F that is connected to a rocker switch 3G. The rocker switch 3G has a neutral middle setting and, given actuation to the left switch side, initiates a reduction of a specific parameter as long as or, respectively, as often as the left switch side remains depressed. Actuation of the right switch side leads to an increase of the appertaining parameter. Which parameter is modified by the rocker switch 3F can be selected by the sliding switch 3F. If the sliding switch 3F is located in the switch setting "1", the volume can be adjusted via the rocker switch 3G. Furthermore, the tone of the appertaining hearing aid device can be modified in the switch position "2" of the sliding switch 3F, by, for example, effecting an increase or decrease of the bass. Analogously, in the switch position "3" the middle frequency range is raised or lowered, and in the switch position "4" the treble is raised or lowered.

The remote control 1 according to the exemplary embodiment is equipped with a display 4 via which specific Information can be graphically visualized. For example, the different parameters that are associated with the sliding switch 3F in the respective positions can be shown on the display 4. The display 4 is in particular of advantage, however, when current properties, settings and states of one or more hearing aid devices 1 controlled via the remote control 1 can also be displayed therewith. One such setting can be, for example, the currently active auditory program. This is particularly of interest when the appertaining hearing aid device is equipped with the capability for an automatic situation recognition, and thus the user can check by means of the remote control whether the present auditory situation has been correctly detected by the automatic situation recognition circuitry. Further useful information is the current charge state of the voltage source of the appertaining hearing aid device. This can also be visualized on the display, for example in the form of a bar.

In addition to the optical display in the form of the display 4, the remote control 1 according to the exemplary embodiment also has a speaker 5 as well as a vibrator 6 to emit an acoustic signal and a haptic signal, respectively. These signals preferably serve as warning signals, for example to warn of a battery running low, The remote control 1 according to the exemplary embodiment is executed as a modular remote control with a base module 2 and a detachable receiving module 7 that can be connected with the base module 2. The receiving module 7 is optional and expands the functional scope of the remote control 1. The base module 2 according to the exemplary embodiment is only able to transmit electromagnetic signals from the remote control 1 to at least one hearing aid device. When signals also be received from a hearing aid device, the receiving module 7 is necessary. The receiving module 7 contains components necessary for reception of a electromagnetic signal originating from a hearing aid device, such as, for example, a receiving unit with an electronic receiver component 9A and an antenna 9B connected therewith. Instead of an additional antenna 9B the receiver component 9A can be connected with the antenna that Is present in the base module 2 for transmission, which is thus fashioned as a quasi-transmission and reception antenna. In the present exemplary embodiment, the current charge state of the battery of an appertaining hearing aid device can only be correctly displayed on the display 4 when the receiving module 7 is also present in the remote control 1. If the receiving module 7 is not present, only an estimate of the charge state of the voltage source can be displayed that is generated, for example, based on the operating time.

In the remote control 1 according to the exemplary embodiment, the receiving module 7 also has operating elements 8A and 8B. Given a remote control 1 held correctly in the hand, these operating elements 8A and 8B are not located on the housing top side of the remote control 1 or of the receiving module 7, but rather the operating elements 8A and 8B are disposed significantly orthogonally to the operating elements 3A-3G disposed on the housing top side of the remote control 1. By this design, an easy differentiation is possible between operating elements which, when actuated effect only a signal transmission from the remote control 1 to a hearing aid device, and operating elements that effect a return transmission of a signal from the hearing aid device to the remote control 1. Differentiation can also be made between the different functions in this manner when the remote control is not within the signed of the user when operated, for example because the user is located in a dark room or if the user desires that use of the remote control 1 should be undetected by other people and therefore ensues in a pocket. Error functions, for example a mistakenly executed program change when only the current state of the voltage source should be queried, are thereby largely prevented.

The remote control 1 according to the exemplary embodiment is essentially fashioned in the shape of a parallel piped, but the invention encompasses remote controls that are designed with ergonomic considerations and therefore do not necessarily exhibit planar or rectilinear housing sides. According to the invention it is sufficient for operating elements that effect a pure data transmission to a hearing aid device, and operating elements with which data transmission is also initiated from a hearing aid device to the remote control, be arranged on different housing sides, as long as this different arrangement is recognizable solely by touching the remote control.

Although modifications and changes may be suggested by those skilled in the art, it is the intention of the inventors to embody within the patent warranted hereon all changes and modifications as reasonably and properly come within the scope of their contribution to the art.

We claim as our invention:

1. A remote control for a hearing aid device comprising:

a housing having a plurality of housing sides, with a first of said housing sides being disposed in an easily tactilely distinguishable relation to a second of said housing sides;

first operating elements disposed on said first of said housing side for, upon actuation of any of said first operating elements, effecting transmission of a control signal from the housing to a hearing aid device;

at least one second operating element disposed on said second of said housing sides, with actuation of said at least one second operating element causing both transmission of a signal from said housing to a hearing aid device and transmission of a signal from the hearing aid device to the housing; and an indicator generator at said housing for, dependent on said signal from said hearing aid device to said housing, generating a humanly perceptible indicator of at least one of a property of the hearing aid device, a state of the hearing aid device, and a setting of the hearing aid device.

2. A remote control as claimed in claim 1 wherein said first of said housing sides is disposed substantially orthogonally to said second of said housing sides.

3. A remote control as claimed in claim 1 wherein said first of said housing sides has dimensions that significantly differ from dimensions of said second of said housing sides.

4. A remote control as claimed in claim 1 comprising a plurality of second operating elements, all disposed on said second of said housing sides.

5. A remote control as claimed in claim 4 wherein all of said first operating elements are exclusively disposed on said first of said housing sides.

6. A remote control as claimed in claim 1 comprising a base module containing a transmitter for transmitting said signal to said hearing aid, and a receiving module detachably connectable to said base module, said receiving module containing a receiver for receiving said signal from said hearing aid device, and wherein said housing comprises a housing of said base module and a housing of the receiving module connected to the base module, and wherein said first of said housing sides is a side of said housing of said base module and said second of said housing sides is a side of said housing of said receiving module.

7. A remote control as claimed in claim 1 wherein said first operating elements include a selection element for selectively applying said control signal to one of a first heating aid device or a second hearing aid device, or to both of a first hearing aid device and a second hearing aid device.

8. A remote control as claimed in claim 1 wherein one of said first operating elements comprises a selection device allowing selection of different functions for another of said first operating elements.

9. A remote control as claimed in claim 1 wherein said indicator generator is selected from the group consisting of visual displays, acoustic signal generators and vibrators.

* * * * *